United States Patent [19]

Kawaguchi

[11] 4,438,916

[45] Mar. 27, 1984

[54] PAPER FEEDER

[75] Inventor: Shoichi Kawaguchi, Toride, Japan

[73] Assignee: Komori Printing Machinery Co., Ltd., Tokyo, Japan

[21] Appl. No.: 354,102

[22] Filed: Mar. 2, 1982

[30] Foreign Application Priority Data

Mar. 4, 1981 [JP] Japan ..... 56/30781
Mar. 4, 1981 [JP] Japan ..... 56/30783

[51] Int. Cl.[3] ..... B65H 3/08
[52] U.S. Cl. ..... 271/93; 271/98
[58] Field of Search ..... 271/91, 92, 93, 98, 271/107, 11, 14, 30 R, 31; 414/121

[56] References Cited

U.S. PATENT DOCUMENTS 3,931,964 1/1976 Schwebel ..... 271/93
3,937,457 2/1976 Schwebel ..... 271/92

FOREIGN PATENT DOCUMENTS 51-7404 3/1976 Japan .
55-7183 1/1980 Japan .

*Primary Examiner*—Bruce H. Stoner, Jr.
*Assistant Examiner*—Lisa M. Rosenberg
*Attorney, Agent, or Firm*—Remy J. VanOphem

[57] ABSTRACT

A paper feeder comprises a frame, a separation suction device mounted on the frame and substantially vertically movable for picking up stacked sheets one at a time, a transport suction device mounted on the frame and substantially horizontally movable for transferring the picked-up sheet from the separation suction device, and an adjustment device for adjusting the separation suction device tiltably back and fourth and laterally. The adjustment device includes a nozzle support pivotably mounted on the frame for angular movement about an axis thereof and supporting the separation suction device tiltably in back-and-forth and lateral directions, a nut pivotably mounted on the nozzle guide at an upper end thereof, an adjustment shaft having a threaded portion held in threaded engagement with the nut, and an adjustment knob having an axial bore off center with respect to the adjustment knob and rotatably mounted on the frame, the adjustment shaft extending through the axial bore for angular movement about its own axis.

6 Claims, 11 Drawing Figures

PAPER FEEDER

BACKGROUND OF THE INVENTION

The present invention relates to an automatic paper feeder for supplying sheets stacked on a stacking table one at a time to sheet-fed presses, sheet folding machines or the like, and more particularly to an improvement in a mechanism for adjusting the attitude of a separation suction device in such an automatic paper feeder.

Machines for handling sheets of paper, such as sheet-fed printing machines or presses and sheet folding machines, include a paper feeder for drawing sheets of paper stacked on a stacking table one by one and feeding the sheets in the forward direction into the machine. Known such paper feeders comprise separation suction devices movable vertically for sucking one of the sheets at a time, transport suction devices movable forward for feeding the picked-up sheet, an air blower for shuffling several uppermost sheets, and a probing foot for separating the sucked sheet from a next lower sheet on the sheet stack. The separation suction devices have suction nozzles which are positionally adjusted in advance so as to be inclined with respect to the direction of feed and a direction transverse thereto, and are movable upwardly in a direction at an angle to the vertical direction, so that the separation suction devices can correct the orientation of the sheet and keep the latter taut while moving upwardly. Such adjustment, however, is time-consuming and must be carried out by a skillful operator, must be repeated before proper adjustment is achieved, and results in an undesirable downtime of the printing machine or the like. There has been proposed a device for adjusting the separation suction devices while the printing machine or the like is in operation. The proposed device, however, is large in size and complicated, fails to effect smooth paper feeding, is noisy in operation, composed of an increased number of parts, costly to build, and relatively unsafe for the operator.

SUMMARY OF THE INVENTION

It is a primary object of the present invention to provide a paper feeder having separation suction devices which can be quickly and easily be adjusted in attitude for an increased sheet feeding efficiency.

Another object of the present invention is to provide a paper feeder which is small in size.

Still another object of the present invention is to provide a paper feeder which is less subjected to vibrations for smooth paper feeding and reduced noise.

A still further object of the present invention is to provide a paper feeder which is composed of a reduced number of parts and is less costly to construct.

A still further object of the present invention is to provide a paper feeder having separation suction devices which are adjustable in attitude relatively safely.

According to the present invention, there is provided a paper feeder comprising a frame, a separation suction device mounted on the frame and substantially vertically movable for picking up stacked sheets one at a time, the separation device having a guide nozzle, a transport suction device mounted on the frame and substantailly horizontally movable for transferring the picked-up sheet from the separation suction device, and an adjustment device for adjusting the separation suction device tiltably back and forth and laterally, the adjustment device including a nozzle support pivotably mounted on the frame for angular movement about a first axis, a pin having a second axis transverse to the first axis and by which the guide nozzle is pivotably supported on the nozzle support, a nut pivotably mounted on the nozzle guide at an upper end thereof, an adjustment shaft having a threaded portion held in threaded engagement with the nut, and an adjustment knob having an axial bore off center with respect to the adjustment knob and rotatably mounted on the frame, the adjustment shaft extending through the axial bore for angular movement about its own axis.

The above and other objects, features, and advantages of the present invention will become more apparent from the following description when taken in conjunction with the accompanying drawings in which certain preferred embodiments are shown by way of illustrative example.

DETAILED DESCRIPTION

Figure 1:
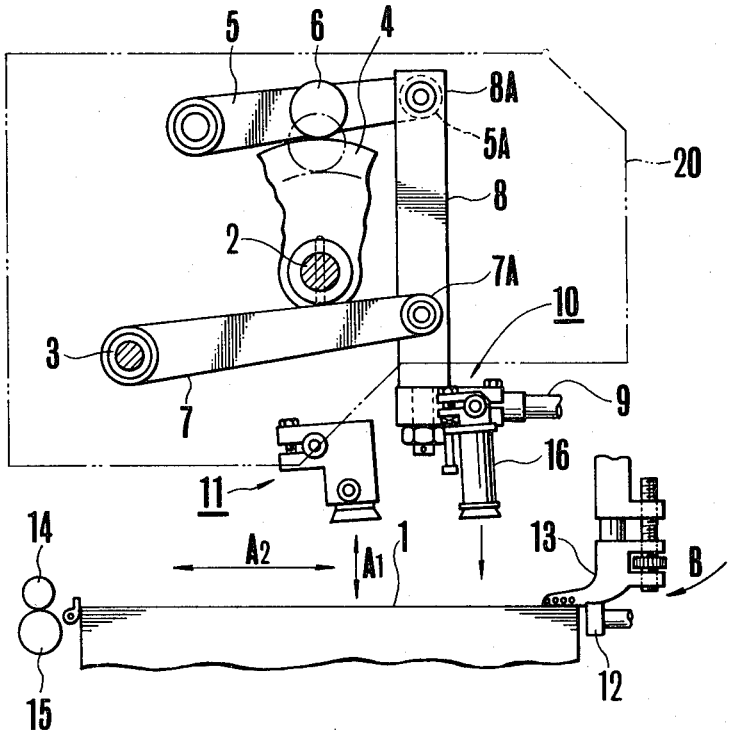
FIG. 1 PRIOR ART
FIG. 1 is a side elevational view of a conventional paper feeder device.

A conventional paper feeder as shown in FIG. 1 comprises a cam shaft 2 and a lever shaft 3 supported by and extending between sidewalls of a sucker frame 20 in overlying relation to a stacked pile of sheets 1 of paper on a table (not illustrated). The cam shaft 2 has a cam 4 against which there is held a cam follower 4 rotatably mounted on a swingable cam lever 5. A support lever 7 has one end secured to the lever shaft 3 and an opposite distal end 7A to which there is pivotably attached a vertical lever 8 having an upper end 8A pivotably mounted on a distal end 5A of the cam lever 5. The vertical lever 8 supports on its lower end a pair of separation suction devices 10 (only one shown) spaced apart from each other in a direction normal to the sheet of the drawing and coupled to a source of vacuum through air hoses 9. A pair of transport suction devices 11 (only one illustrated) are disposed forward (leftward in FIG. 1) of the separation suction devices 10 and drivable by a non-illustrated driver to move upwardly and downwardly, and back and forth in the directions of the arrows A1 and A2. An air blower 12 and a probing foot 13 are positioned adjacent to trailing edges of the stacked sheets 1. A pair of timing and transport rollers 14, 15 which are vertically held against each other are located adjacent leading edges of the piled sheets 1. The probing foot 13 has a detector (not shown) for detecting the topmost sheet on the sheet stack to keep the topmost sheet at a constant level at all times by raising the stacker table through operation of an automatic table lifter (not shown). A stream of air is always discharged from the air blower 12 against the trailing edges of several upper sheets to facilitate separation thereof from each other.

When the cam shaft 2 rotates to cause the cam 4 to turn about the cam shaft 2 until a smaller-diameter portion of the cam 4 (indicated by the dot-and-dash line) reaches the cam follower 5, the separation suction devices 10 are moved downwardly to bring lower open ends of suctions nozzles 16 of the devices 10 into contact with the uppermost sheet 1, whereupon a vacuum is developed in the suction nozzles 16 by drawing air through the air hoses 9 to attract the uppermost sheet 1 to the lower open ends of the suction nozzles 16. Then, the separation suction devices 10 are lifted with the uppermost sheet 1 carried thereon, and the probing foot 13 moves in the direction of the arrow B into a space defined between the lifted sheet and a next sheet below. At this time, air is ejected from the probing foot 13 into the space as the probing foot 13 holds down the pile of sheets 1. The picked-up sheet 1 is then attracted to the transport suction devices 11, whereupon the separation suction devices 10 are not vacuumized and start descending. The transport suction devices 11 as they are lowered more forward (leftward) to take the sheet 1 away from the separation suction devices 10. When the leading edge of the sheet 1 is inserted between the feeding rollers 14, 15, the transport suction devices 11 are relieved of vacuumization to release the sheet 1, and then are raised, allowing the sheet 1 to be fed along by the rollers 14, 15. One cycle of paper feeding operation is completed when the suction devices 10, 11 return to their starting positions, respectively.

With the prior paper feeder, the sheets 1 sometimes tend to be inclined with respect to the direction of feed of the sheets or skewed slightly out of alignment as they are stacked on the table, and it is necessary to correct the sheets 1 out of possible skewed orientation while they are transferred from the separation suction devices 10 to the transport suction devices 11. The separation suction devices 10 spaced laterally widthwise of the sheet 1 are required to keep the sheet 1 taut widthwise thereof (in a direction normal to the sheet of the drawing) since slacked sheets 1 would lie in the path of movement of the probing foot 13 as the latter advance. To meet these requirements, the axes of the suction nozzles 16 are slightly inclined with respect to the direction of feed of the sheets 1 or a direction transverse thereto, and are movable upwardly in a direction at an angle to the vertical direction, so that the sheets 1 are corrected to have a proper orientation or tensioned by the separation suction devices 10 while the latter are ascending. Although adjustment of the angle of inclination of the suction nozzles 16 should preferably be made while observing the way the sheet 1 is picked up by the separation suction devices 16, the known paper feeder shown in FIG. 1 requires that the paper feeder and hence an associated printing machine or the like be shut down for such adjustment, resulting in an undesirable downtime. The adjusting procedure should be repeated to make a proper adjustment, and hence is tedious and time-consuming, and needs to be carried out by a skilled operator.

A proposed adjusting device, as disclosed in U.S. Pat. No. 3,937,457, is secured to the sucker frame for enabling an adjusting process to be effected during operation of the paper feeder. The proposed adjusting device includes a first control unit for adjusting the suction nozzles pivotably back and forth and a second control unit for adjusting the suction nozzles pivotably in a lateral direction, the first and second control units being widely spaced from each other. The spaced control units, however, cannot easily be actuated at the same time, and take up a relatively large space in the paper feeder, which becomes large in size. Springs which support adjustment rods and parts to be adjusted are relatively long and tend to vibrate while the paper feeder is in operation, with the results that the sheets cannot be fed smoothly due to the spring vibrations, and the paper feeder produces noises. With brackets required to support the control units and the springs added to support the parts to be adjusted, the number of parts needed is increased, and the paper feeder becomes costly to construct. Since the parts to be adjusted and the adjusting mechanism are all located outside of the housing, there is a danger for the operator to touch those parts and adjusting mechanism.

Figure 2:
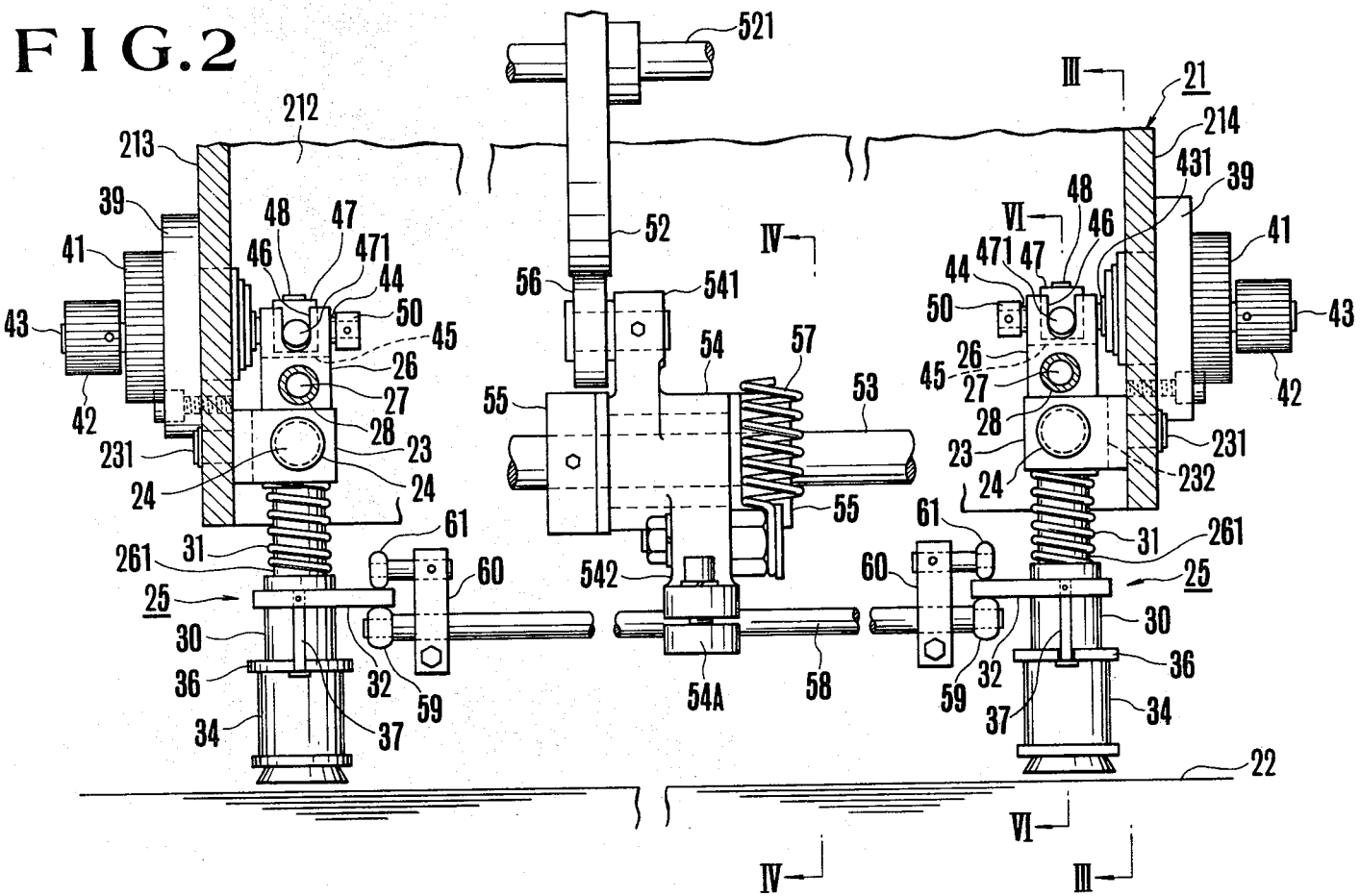
FIG. 2 is a front elevational view of a paper feeder device, with a front plate detached, according to the present invention.

According to an embodiment of the present invention, as shown in FIGS. 2 through 8, a paper feeder for use with printing machines, paper folding machines or the like comprises a suction head frame structure or sucker frame 21 which is supported on a paper feeder frame and which includes a front plate 211, a rear plate 212 and lateral sidewalls 213, 214. The sucker frame 21 is movable in a direction normal to the sheet of the drawing of FIG. 2, and can be fixedly secured in a desired position. The front plate 211 is located at the trailing edges of stacked sheets 22, and the rear plate 212 is positioned at the leading edges of the stacked sheets, which are closer to the printing machine or the paper folding machine into which the sheets 22 are to be supplied. The paper feeder also includes a pair of separation suction devices 25, 25 and members for supporting and controlling these devices. Since one of the separation suction devices 25, 25 with the associated members is the mirror image of the other, as shown in FIG. 2, only the separation suction device 25 mounted on the sidewall 214 and the related parts will chiefly be described, with the description of the other separation suction device 25 being omitted for brevity.

Each of the sidewalls 213, 214 of the sucker frame 21 supports a nozzle support 23 having a pivot shaft 231 pivotably mounted on the sidewall. The nozzle support 23 has a U-shaped groove 232 opening upwardly and downwardly and at one side and receiving therein a guide nozzle 26 of the separation suction device 25, which is angularly movably supported on the nozzle support 23 by a pin 24. The pin 24 has a vent hole 241 (FIGS. 5 and 6) located axially centrally thereof and extending diametrically across the axis of the pin 24. The guide nozzle 26 is angularly movable about the pivot shaft 231 back and forth in the direction of feed of the sheets 22, and also angularly movable about the pin 24 laterally widthwise of the sheets 22. The guide nozzle 26 has a central bore 27 communicating with the vent hole 241 and opening at a lower end of the guide nozzle 26. The central bore 27 has an upper branch 28 disposed upwardly of the pin 24 and coupled to an air hose 29 (FIG. 6) connected to a source of vacuum (not shown) through the front plate 211 of the sucker frame 21. An intermediate cylindrical nozzle 30 is telescopically fitted over a lower cylindrical portion 261 of the guide nozzle 26 and is normally urged downwardly by an outer compression coil spring 31 disposed around the guide nozzle 26 and acting between a shoulder or step 262 of the guide nozzle 26 and an upper end of the intermediate cylindrical nozzle 30. The intermediate cylindrical nozzle 30 has an upper flange 32 extending laterally and sandwiched between an upper guide 61 and a lower guide 59 for limiting vertical movement of the intermediate nozzle 30. A cup-shaped suction member or nozzle 34 having a bottom is axially slidably fitted over a lower portion of the intermediate nozzle 30, the bottom having a plurality of suction slots or ports 33. The suction nozzle 34 is normally urged downwardly by a compression coil spring 35 acting between the bottom of the suction nozzle 34 and a shoulder or step defined in the guide nozzle 26 around its bore 27, the compression coil spring 35 extending through the intermediate nozzle 30. The suction nozzle 34 is dependent from and limited in its angular motion with respect to the intermediate nozzle 30 by a limitation pin 37 extending between the flange 32 of the intermediate nozzle 30 and an annular flange 36 disposed at an upper end of the suction nozzle 34. The intermediate nozzle 30 is movable upwardly and downwardly with respect to the front plate 211 while being prevented from angular movement by slidable contact with a guide plate 38 attached to an inner surface of the front plate 211.

Figure 7:
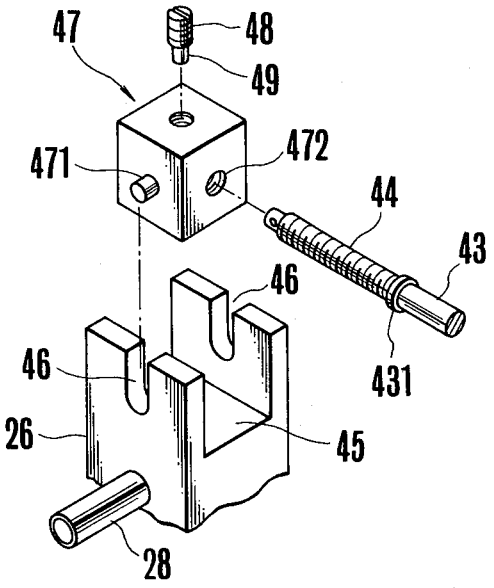
FIG. 7 is an exploded perspective view of a guide nozzle, a nut, and an adjustment rod.
Figure 8:
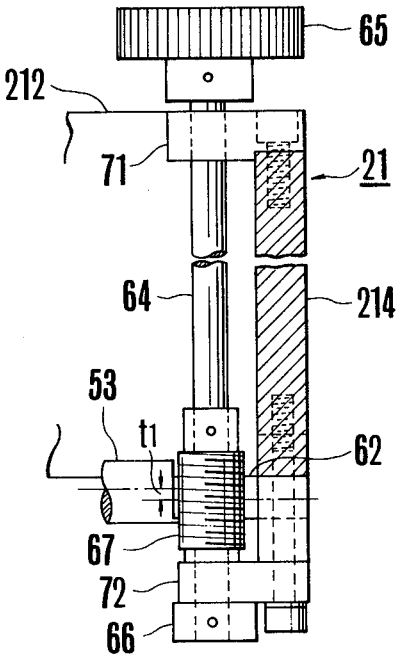
FIG. 8 is a cross-sectional view taken aong line VIII—VIII of FIG. 3.

A bearing 39 is attached to each of the sidewalls 213, 214 of the sucker frame 21 and positioned upwardly of the nozzle support 23. The bearing 39 receives therein an adjustment knob 41 having a bore 40 which is located off center with respect to the bearing 39 or the axis of the knob 41 by a distance t (FIG. 5), the adjustment knob 41 is angularly movable in the bearing 39 and serves to adjust the position of the suction nozzle 34 in the back-and-forth direction. An adjustment rod 43 extends through the bore 40 for rotation about its own axis and has on an outer end a small knob or grip 42 secured thereto and a threaded inner end portion 44 extending into the sucker frame 21. The adjustment rod 43 also has a flange 431 disposed between the grip 42 and the threaded end portion 44. With the grip 42 and the flange positioned one on each side of the adjustment knob 41, the adjustment rod 43 is prevented from being axially displaced. The rod 43 serves to adjust the position of the suction nozzle 34 in the lateral direction transverse to said back-and-forth direction. The guide nozzle 26 has in its upper end a U-shaped slot 45 and a transverse U-shaped slot 46, as shown in FIGS. 2 and 7. In the slot 45, there is disposed a nut 47 supported by a pin 471 and angularly movable in and along the U-shaped slot 46. The threaded end portion 44 of the rod 43 threadedly extends through an internally threaded hole 472 in the nut 47. The adjustment rod 43 is frictionally braked against smooth rotation by a stop 49 mounted in the nut 47 and retained therein by a setscrew 48 threaded into the nut 47. The rod 43 has on its end remote from the grip 42 a collar 50 affixed thereto to determine a terminal position for angular motion of the guide nozzle 26. The adjustment knob 41 is also frictionally braked against smooth rotation by a stop 51 mounted in the bearing 39 and held in position by a setscrew 511.

Figure 3:
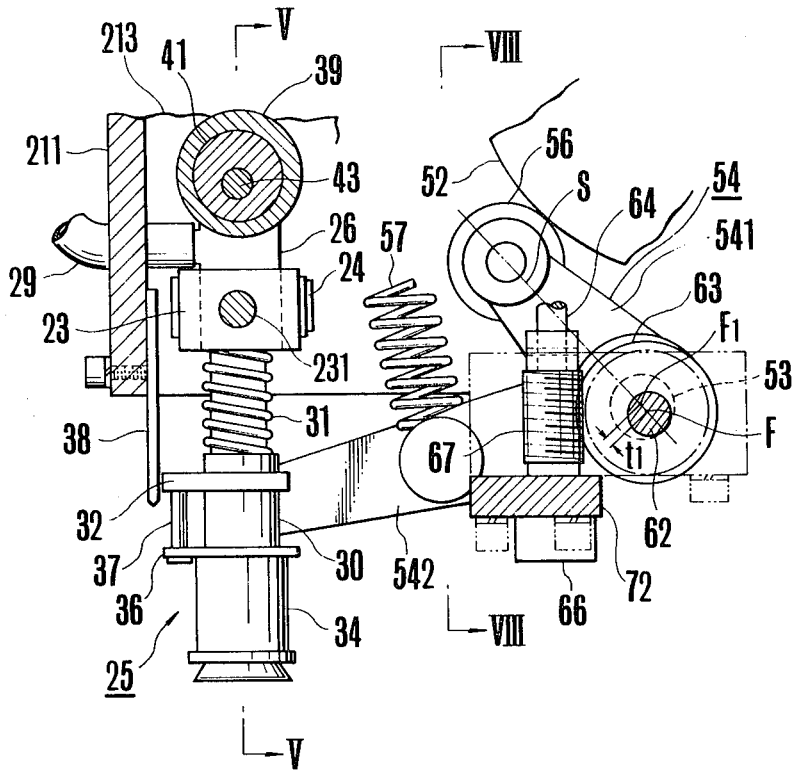
FIG. 3 is a cross-sectional view taken along line IIi—III of FIG. 2.
Figure 4:
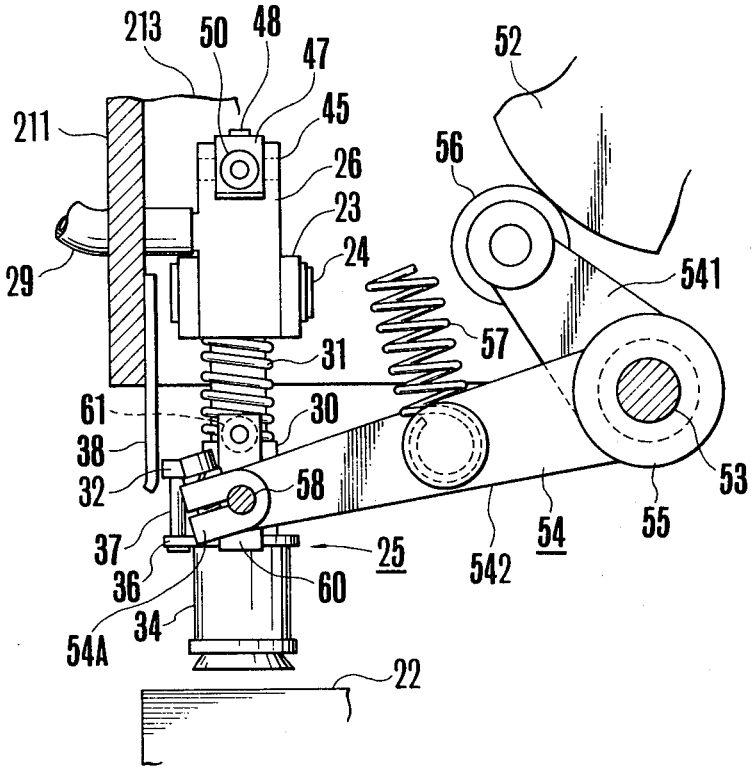
FIG. 4 is a cross-sectional view taken along line IV—IV of FIG. 2.

As shown in FIGS. 2–3, a cam 52 is supported on a cam shaft 521 between the front and rear plates 211, 212 of the sucker frame 21 and is rotatable in synchronization with sucking by the suction nozzles 34 of the sheets 22 one at a time. A lever shaft 53 is supported for angular movement about its own axis downwardly of the cam 52. An L-shaped cam lever 54 having two arms 541, 542 is angularly movably fitted over the lever shaft 53 and is prevented from axial movement by a collar 55 mounted on the lever shaft 53. The cam lever arm 541 has on one distal end a cam follower 56 held against a cam surface of the cam 52. A tension spring 57 acts between the sucker frame 21 and the cam lever arm 542 to normally urge the cam follower 56 into pressed engagement with the cam surface of the cam 52. A guide rod 58 is attached to a distal end of the cam lever 54 and has on each of axial ends the lower guide 59 which cooperates with the upper guide 61 in sandwiching the flange 32 of each intermediate nozzle 30. Each of the ends of the guide rod 58 also supports a guide support 60 fixedly mounted thereon adjacent to the lower guide 59 and mounting thereon the upper guide 61.

Figure 9:
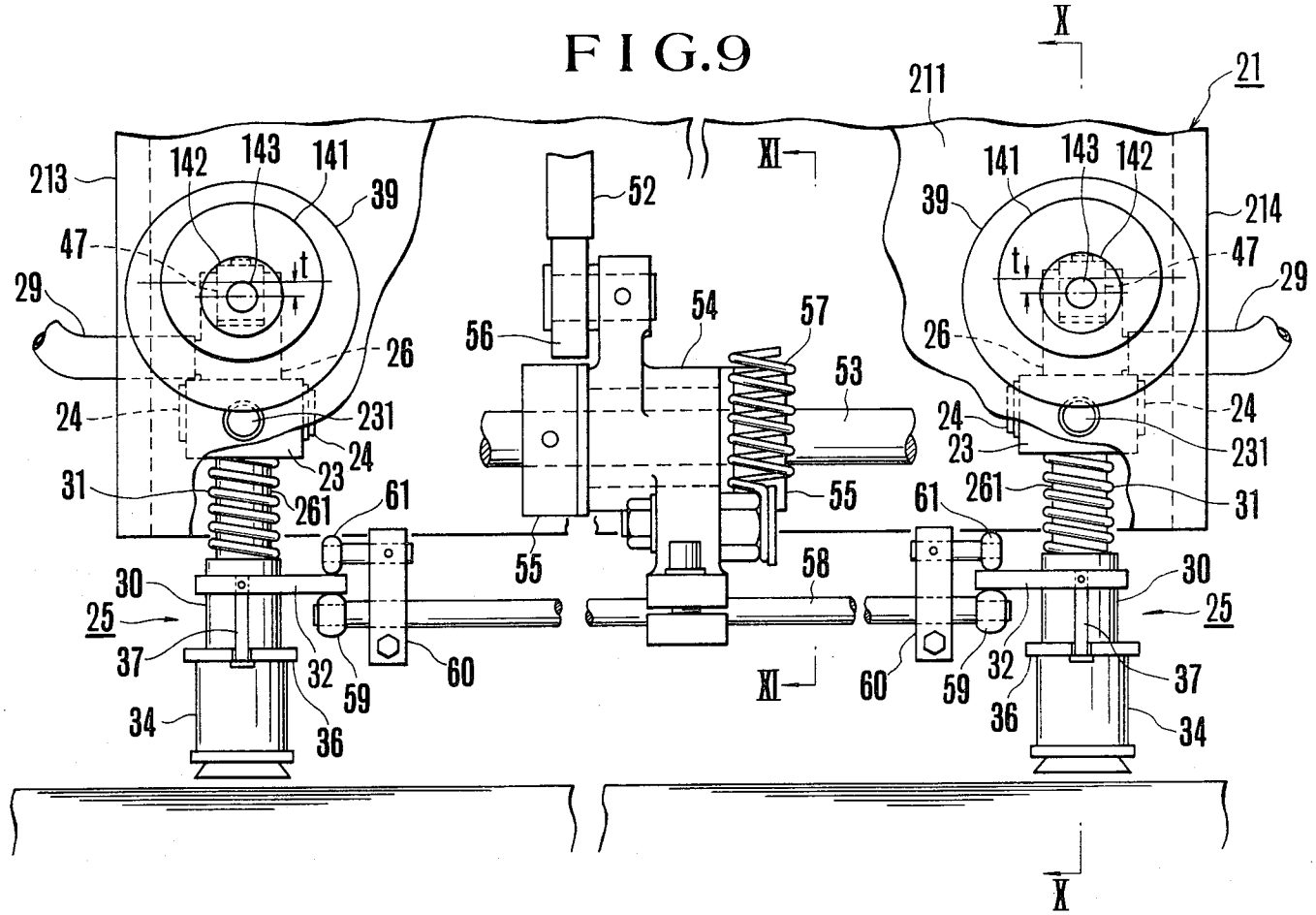
FIG. 9 is a front elevational view of a paper feeder, with a front plate partly broken away, according to another embodiment.

As shown in FIGS. 3 and 9, the lever shaft 53 has axial ends 62 journalled respectively in the sidewalls 213, 214 of the sucker frame 21, each end 62 being disposed off center by a distance $t_1$ with respect to the center of an axial bore in the cam lever 54 which fits over the lever shaft 53. One of the eccentric axial ends 62 which extends inwardly of the sucker frame 21 supports thereon a worm wheel 63. A worm shaft 64 vertically extends between and is angularly movably supported by upper and lower bearing members 71, 72, the worm shaft 64 being prevented from being axially displaced by a knob 65 and a collar 66 which are mounted respectively on ends of the worm shaft 64. The worm shaft 64 supports a worm 67 secured coaxially thereto and held in mesh with the worm wheel 63. Rotation of the worm shaft 64 by hand gripping the knob 65 causes the lever shaft 63 to turn, thus enabling an axis F1 of the latter to turn around an axis F of the axial end 62 journalled in the sidewall 214. The worm wheel 63 is related in angular phase to the lever shaft 53 such that the axis F1 of the latter will be angularly movable for equal intervals one on each side of a center line of the cam lever 54 (FIG. 3) upon rotation of the worm shaft 64. When the lever shaft 53 is thus angularly moved, an axis of the boss of the cam lever 54 is angularly displaced to thereby move the upper and lower guides 59, 61 upwardly or downwardly, whereupon the fixed position for the intermediate nozzles 30 are displaced upwardly or downwardly.

Figure 6:
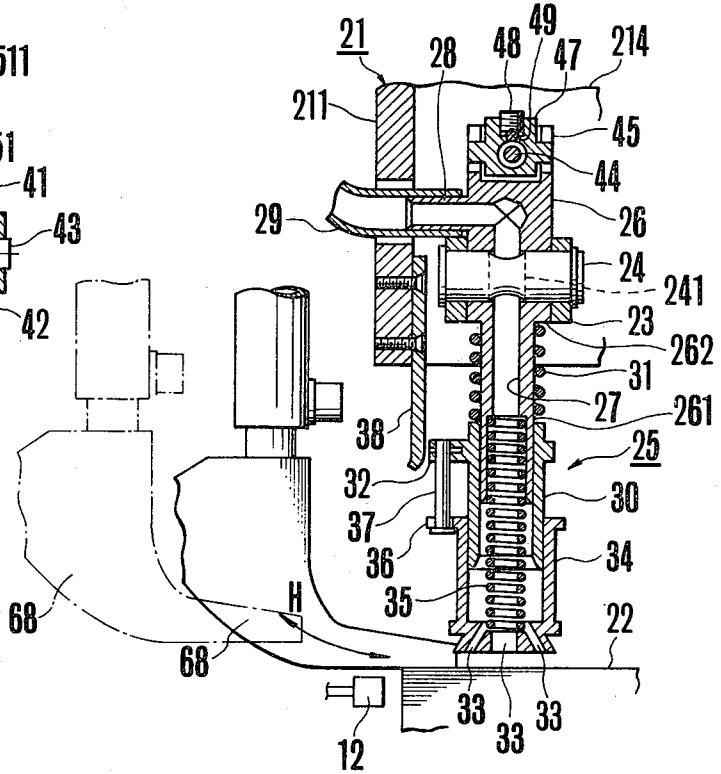
FIG. 6 is a cross-sectional view taken along line VI—VI of FIG. 2.
Figure 5:
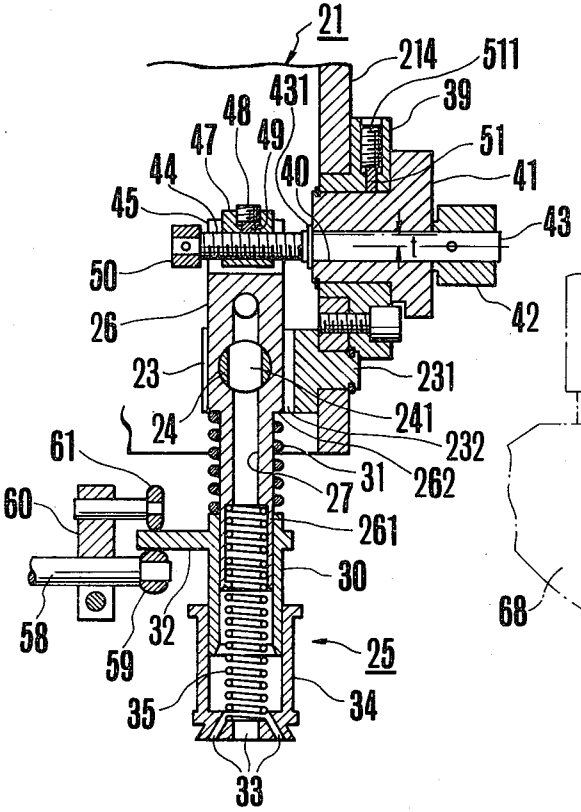
FIG. 5 is a cross-sectional view taken along line V—V of FIG. 3.

As illustrated in FIG. 6, a probing foot 68 is disposed adjacent to each of the suction nozzle 34 and is movable in the direction of the arrow H from a retracted position shown by the broken lines to an advanced position shown by the solid lines. An air blower 12 is also disposed adjacent to each of the suction nozzle 34 and the stacked sheets 22. The probing foot 68 and the air blower 12 are of the same construction as that of the conventional probing foot and air blower as shown in FIG. 1, and hence will not be described in detail. Furthermore, the paper feeder of the present invention also includes transport suction devices, and timing and transport rollers (not shown) which are of the same structure as that of the corresponding known parts as illustrated in FIG. 1, and no description thereof will be given.

The paper feeder thus constructed will operate as follows: First, a stacked pile of sheets 22 of paper is loaded on the table, and the air blowers 12 are actuated to blow air streams against an upper portion of the sheet stack for facilitating separation between sheets 22. At this time, the cam follower 56 is held against a larger-diameter portion of the cam 52, and hence the intermediate nozzles 30 are in the lower position with the upper and lower guides 61, 59 which sandwich the flanges 32 being lowered by the cam lever 54 and the guide rod 58. The suction nozzles 34 are lowered under the resiliency of the inner springs 35. Operation of the paper feeder is now started. Air is drawn through the air hoses 29 to attract the topmost sheet 22 to the bottoms of the suction nozzles 34, thus closing the suction ports 33 therein, whereupon a vacuum is developed in the suction nozzles 34 and the bores 27. The inner springs 35 are compressed under the atmospheric pressure, causing the suction nozzles 34 to move upwardly with the sheet 22 attracted thereto. When the suction nozzles 34 stop upon impinging engagement of their flanges 36 with the flanges 32 of the intermediate nozzles 30, the probing foot 68 moves onto the next sheet 1 and presses down the stack of sheets 1 to prevent the latter from flying up. At this time, since the cam follower 56 reaches a smaller-diameter portion of the cam 52, the guides 61, 59 on the guide rod 58 are moved upwardly to cause the intermediate nozzle 30 and the suction nozzle 34 with the inner spring 35 in compression to ascend in unison as they compress the outer spring 31. When the intermediate nozzle 30 and the suction nozzle 34 reach their uppermost position, the probing foot 68 discharges air against the entire underside of the raised sheet 22, which is then caused to float over the piled sheets 22. The transport suction devices (not shown) are now actuated to attract the floating sheet 22, and the separation suction devices 25 are inactivated, whereupon the interior of the suction nozzles 34 approaches the atmospheric pressure. The suction nozzles 34 descend rapidly under the force of the inner spring 35 to lower the picked-up sheet 22, which is allowed to be released from the suction nozzles 34. Thereafter, the transport suction devices transfer the sheet 22 away from the separation suction devices 25 toward the timing and transport rollers. The probing foot 68 returns to its retracted position upon downward movement of the the separation suction devices 25. One cycle of paper feeding operation is completed when the intermediate nozzles 30 are caused to descend by the cam 52.

During the foregoing paper feeding operation, the picked-up sheet 22 tends to fly up when the suction nozzles 34, on their upward movement, impinge on the flanges 32 of the intermediate nozzles 30. A current of air is introduced by such flying of the picked-up sheet 22 from the trailing edge thereof toward the center thereof. When the intermediate nozzles 30 reach their uppermost position with the outer spring 31 compressed, the sheet 22 is caused to fly up again allowing an air current to reach the leading edge portion of the sheet 22. The sheet 22 is lifted by the intermediate nozzles 30 and the suction nozzles 34 as they are moved up under the atmospheric pressure. Such movement of the nozzles 30 and the nozzle 34 under pressure can be effected rapdily and smoothly, permitting high-speed operation of the paper feeder while controlling motion of the picked-up sheet 22. When the sheet 22 is to be transferred to the transport suction devices, the separation suction devices 25 are inactivated to allow the suction nozzles 34 to move the sheet 22 rapidly down under the bias of the springs 35, 31. Thus, the sheet 22 can readily be separated from the separation suction devices 25 without getting skewed slightly out of alignment with other sheets 22.

When it is necessary to correct the sheets 22 into proper orientation or tension the sheets 22 widthwise while the sheets 22 are picked up one at a time by the separation suction devices 25, the latter are adjusted in their angle of inclination. Such adjustment will be carried out as follows: During operation of the paper feeder, the knob 41 is turned while observing the way the sheets 22 are attracted upwardly one by one. since the bore 40 in the knob 41 is disposed off center with respect to the knob 41 itself, the adjustment rod 43 in the bore 40 turns about the axis of the knob 41 upon angular movement of the latter, causing the separation suction device 25 coupled to the rod 43 by the nuts 47 to be tilted back and forth about the shaft 231 of the nozzle support 23. Thus, the angle of inclination of the separation suction device 25 in the back-and-forth direction is adjusted by the knob 41. Turning movement of the grip 42 on the rod 43 causes the nut 47 to move on and along the threaded portion 44 of the rod 43, whereupon the separation suction device 25 coupled to the nut 47 through the U-shaped slot 46 is tilted about the pin 24 in the lateral direction. Therefore, the angle of inclination of the separation suction device 25 in the transverse direction is adjusted by the grip 42. With the separation suction devices 25 thus adjusted, they move upwardly at the adjusted angles of inclination while carrying the sheet 22 attracted to the suction nozzles 34, so that the sheet 22 will be corrected in its orientation and kept taut widthwise when to be transferred to the transport suction devices. The foregoing adjustment can be made while observing the way the picked-up sheet 22 is carried by the separation suction devices 25, with the result that the adjustment can be carried out to a nicety in a short period of time with ease.

For feeding sheets 22 of a different thickness or grade, the knob 65 is turned to cause the lever shaft 53 to be angularly moved by the worm 67 and the worm wheel 63 meshing therewith in such a manner that the axis F1 of the lever shaft 63 turns through an arc around the axis of the eccentric shaft end 62. The upper and lower guides 61, 59 on the guide rod 58 supported on the distal end 54A of the cam lever 54 are moved mainly vertically together with the cam lever 54, resulting in a displacement of the upper and lower limit positions for the intermediate nozzles 30 with their flanges 32 sandwiched between the upper and lower guides 61, 59, and hence the suction nozzles 34. Thus, the distance between the lower surfaces of the suction nozzles 34 and the topmost surface of the stacked sheets 22 is adjusted by the knob 65. Such adjusting operation can be effected in a short period of time while the paper feeder is in operation. The adjustment involves no change in relative positional relationship between the timing and transport rollers and air blowers, and the stacked pile of sheets 22. Paper feeding operation during the adjusting process is not impaired.

Figure 10:
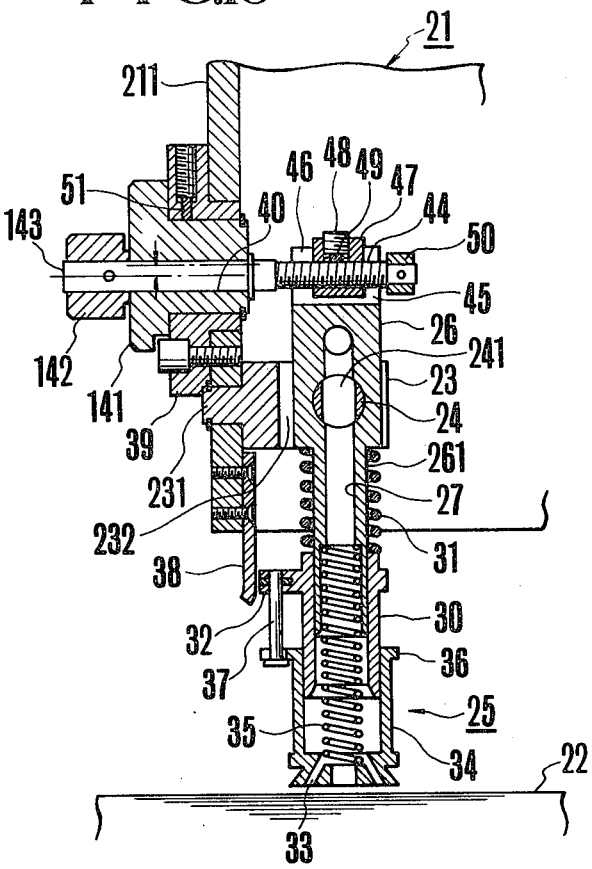
FIG. 10 is a cross-sectional view taken along line X—X of FIG. 9.

FIGS. 9 and 10 illustrate a paper feeder according to another embodiment. The feature of the paper feeder shown in FIGS. 9 and 10 resides in that nozzle supports 23 supporting guide nozzles 26 and various parts 39, 141-143 for tiltably adjusting the guide nozzles 26 back and forth and laterally are mounted on a front plate 211. Only those parts which are different from the parts of the paper feeder according to the foregoing embodiment will be described. Functionally and structurally similar or identical parts shown in FIGS. 9 and 10 are denoted by similar or identical reference characters in FIGS. 2 through 8, and will not be described in detail.

The nozzle supports 23 are pivotably supported by pivot shafts 231 on the front plate 211 at its lateral end portions. Each of the nozzle supports 23 has a U-shaped groove 232 in which the guide nozzle 26 is pivotably supported by a pin 24. The guide nozzle 26 is angularly movable about the pivot shaft 231 laterally widthwise of a stacked pile of sheets 22, and also angularly movable about the pin 24 back and forth in the direction of feed of the sheets 22. A bearing 39 is fixedly mounted on the front plate 211 and supports an adjustment knob 141 journalled rotatably therein and having an axial bore 40 which is off center with respect to the bearing 39 and the knob 141. An adjustment rod 143 extends through the axial bore 40 for rotation about its own axis and has a small knob or grip 143 on an end thereof.

The adjustment rod 143 has an externally threaded portion 44 over which there is threaded a nut 47 received in a U-shaped slot 45 defined in an upper end of the guide nozzle 26 and opening in upward and back-and-forth directions. The upper end of the guide nozzle 26 also has a U-shaped slot (not shown) which opens in upward and lateral directions and receives pins on the nut 47. The guide nozzles 26 are connected to a source of vacuum (not shown) through air hoses extending through holes in sidewalls 213, 214. With the arrangement shown in FIGS. 9 and 10, the guide nozzles 26, 26 can be tiltably adjusted by the knobs 39, 142 mounted on the front plate 211.

Figure 11:
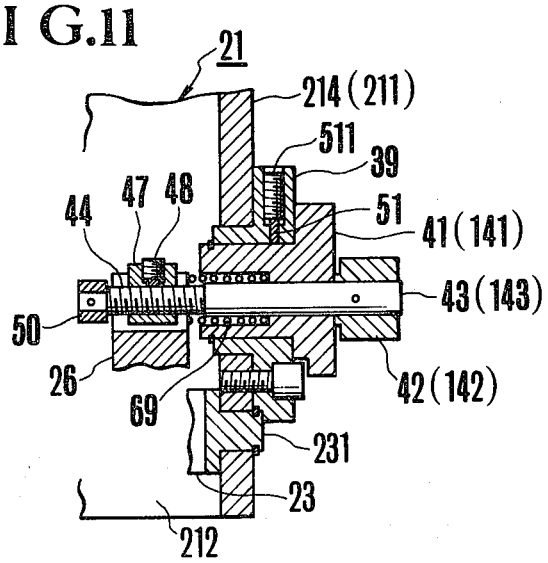
FIG. 11 is a cross-sectional view of an adjustment according to still another embodiment.
Figure 2:
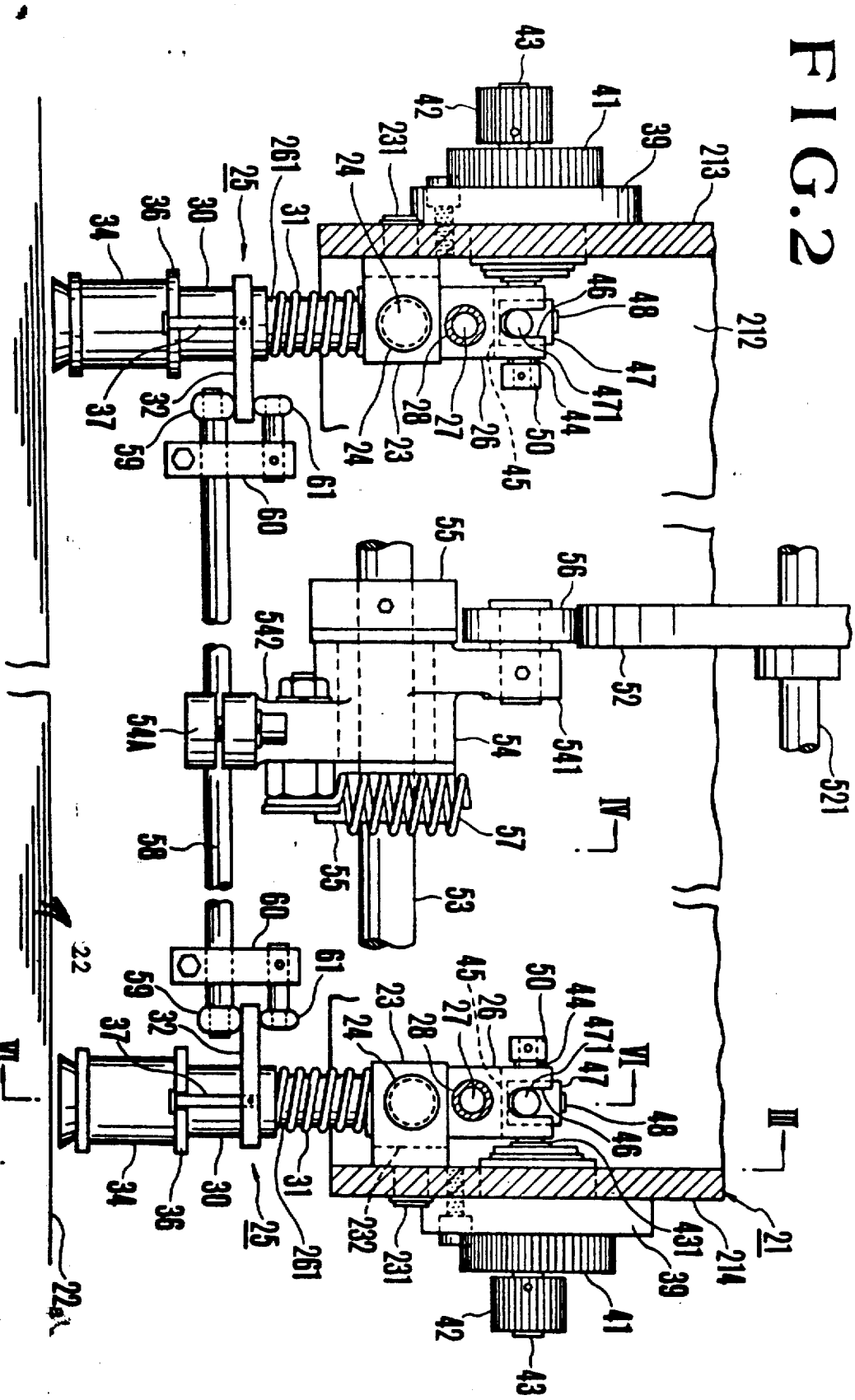
Figure 4:
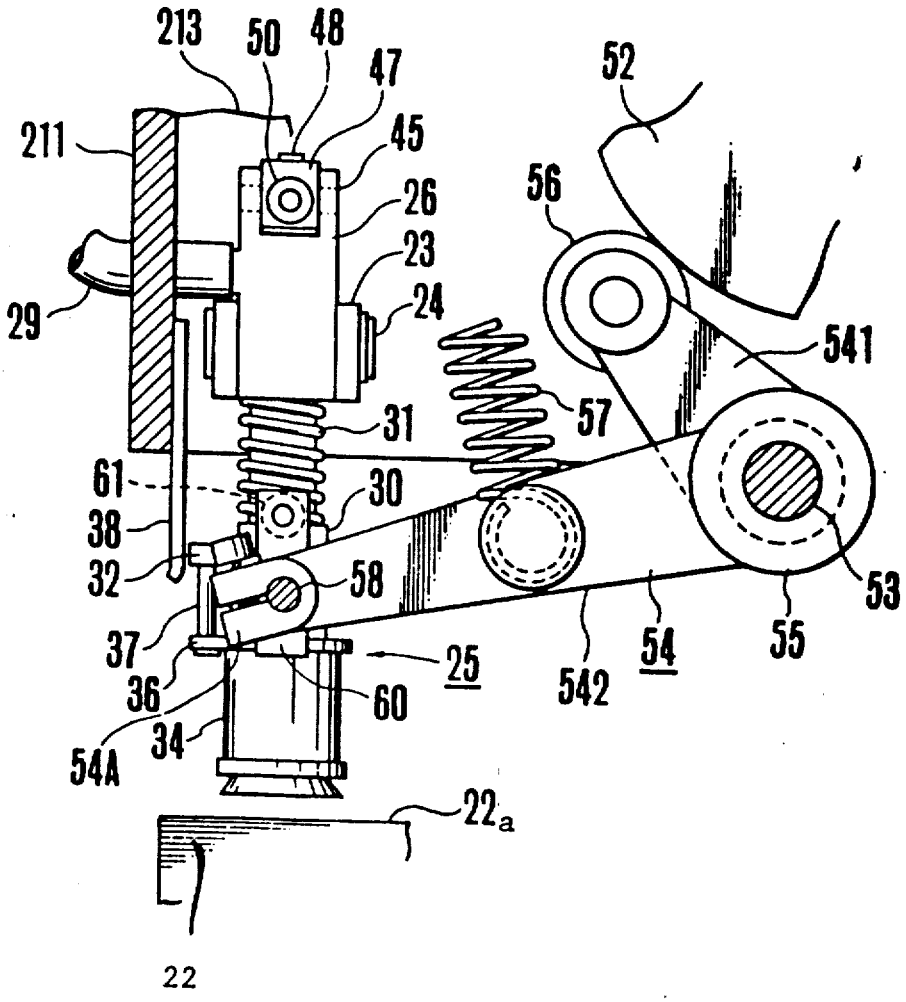
Figure 6:
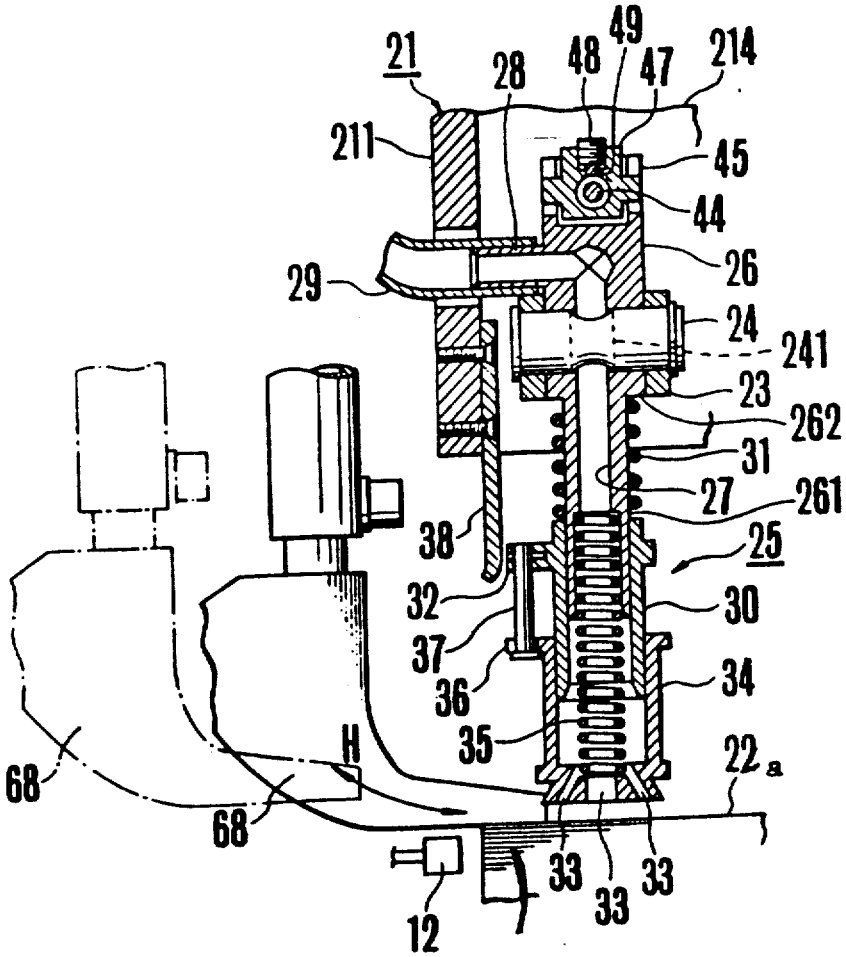
Figure 8:
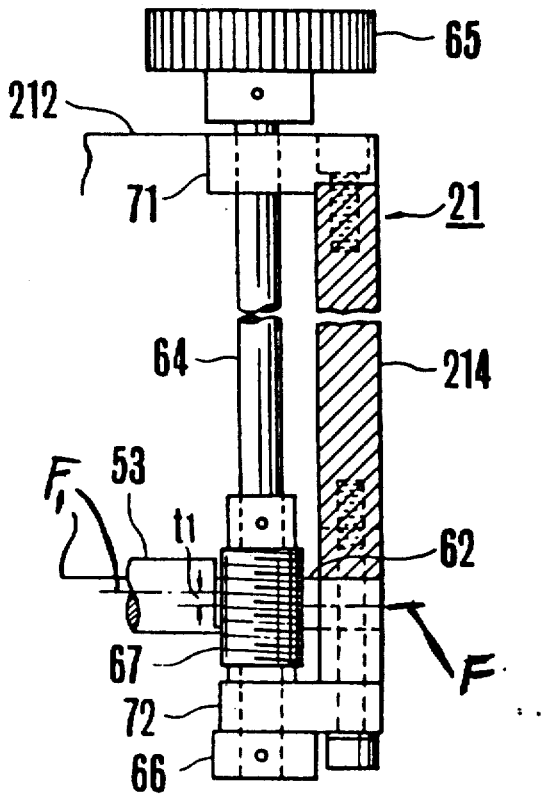
Figure 9:
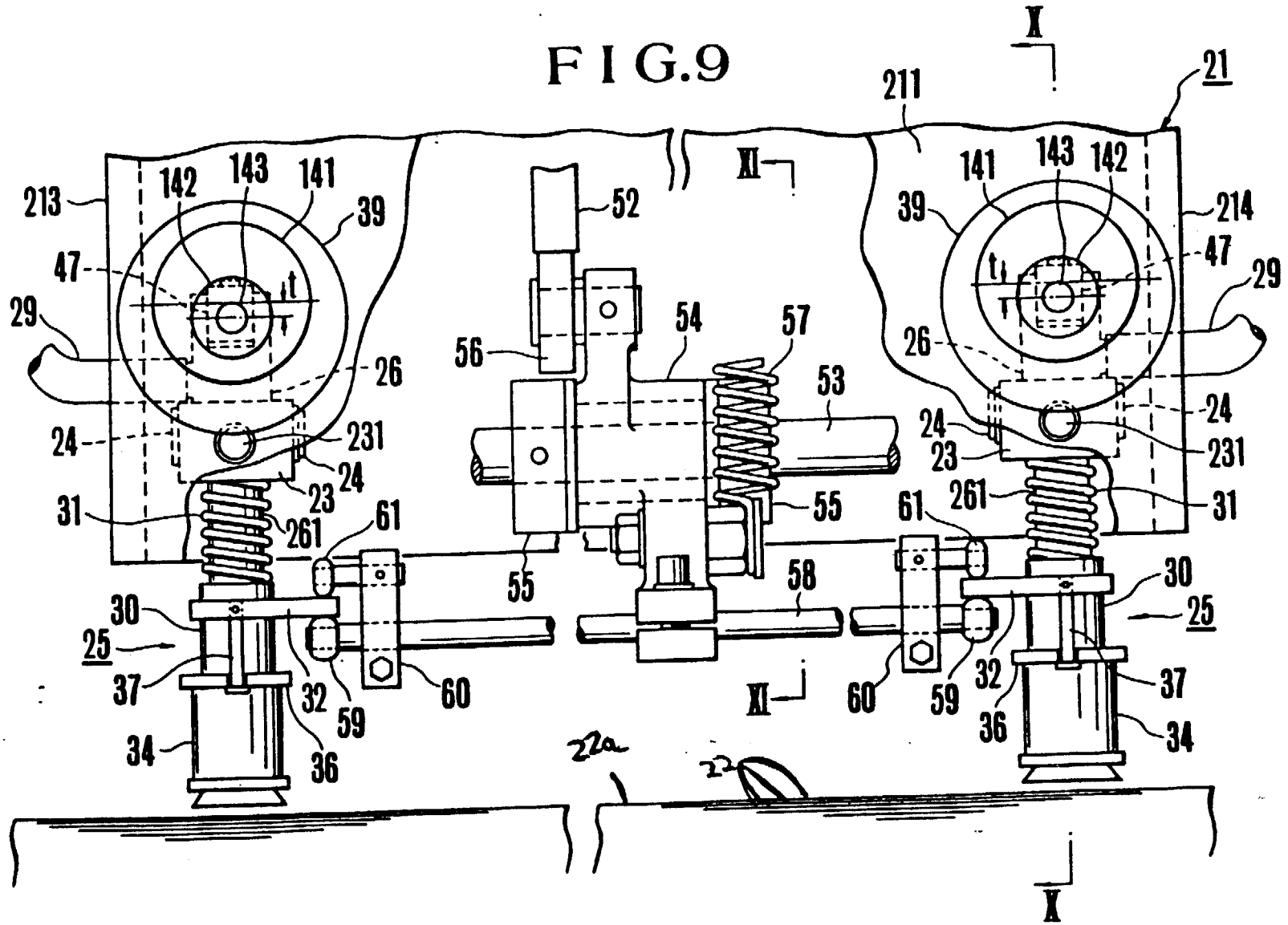
Figure 10:
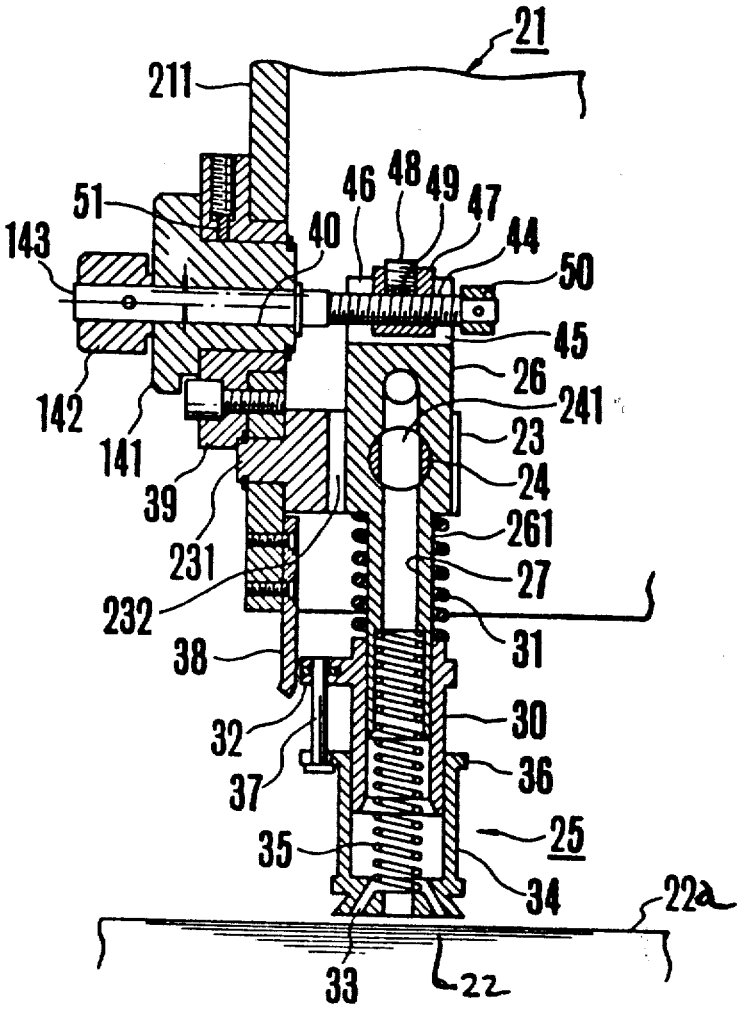

According to still another embodiment shown in FIG. 11, the adjustment shaft 43 or 143 is prevented from axial movement by the small knob 42 on the shaft 43 and a compression coil spring 69 acting between the adjustment knob 41 or 141 and the guide nozzle 26. The guide nozzle 26 and the adjustment shaft 43 or 143 are normally urged in a direction into the sucker frame 21 under the resiliency of the compression coil spring 69.

Although certain preferred embodiments have been shown and described in detail, it should be understood that various changes and modifications may be made therein without departing from the scope of the appended claims.

What is claimed is:

1. A paper feeder comprising a frame, a separation suction device mounted on said frame and substantially vertically movable for picking up stacked sheets one at a time, said separation device having a guide nozzle, a transport suction device mounted on said frame and substantially horizontally movable for transferring the picked-up sheet from said separation suction device, and an adjustment device for adjusting said separation suction device tiltably back and forth and laterally, said adjustment device including a nozzle support pivotably mounted on said frame for angular movement about a first axis, a pin having a second axis transverse to said first axis and by which said guide nozzle is pivotably supported on said nozzle support, a nut pivotably mounted on said guide nozzle at an upper end thereof, an adjustment shaft having a threaded portion held in threaded engagement with said nut, and an adjustment knob having an axial bore off center with respect to said adjustment knob and rotatably mounted on said frame, said adjustment shaft extending through said axial bore for angular movement about its own axis.

2. A paper feeder according to claim 1, wherein said frame has a sidewall, said nozzle support and said adjustment knob being pivotably mounted on said sidewall.

3. A paper feeder according to claim 1, wherein said frame has a front plate, said nozzle support and said adjustment knob being pivotably mounted on said front plate.

4. A paper feeder according to claim 1, wherein said frame has a corner, said nozzle support and said adjustment knob being disposed adjacent to said corner.

5. A paper feeder according to claim 1, wherein said adjustment shaft has a flange and a small knob attached to one end thereof, said adjustment shaft being prevented from axial movement by said flange and said small knob.

6. A paper feeder according to claim 1, wherein said adjustment knob has a recess in its inner end surface, including a compression coil spring disposed in said recess and urging said guide nozzle in one direction.

* * * * *

UNITED STATES PATENT AND TRADEMARK OFFICE

CERTIFICATE OF CORRECTION

PATENT NO. : 4,438,916

DATED : March 27, 1984

INVENTOR(S) : Shoichi Kawaguchi

It is certified that error appears in the above-identified patent and that said Letters Patent is hereby corrected as shown below:

Column 1, line 17, delete "known such" and insert ---- Such known prior art ----. Same line, delete "comprise" and insert ---- include ----.

Column 1, line 39, delete "composed" and insert ---- consists ----.

Column 1, line 40, after "comma", first occurrence, insert ---- is ----. Same line, after "and" insert ---- is ----.

Column 1, line 45, delete "having" and insert ---- which has ----.

Column 1, line 46, delete "which" and insert ---- and ----. Same line, delete "be" second occurrence.

Column 1, line 47, delete "increased" and insert ---- increase in ----.

Column 2, line 26, delete "IIi" and insert ---- III ----.

Column 2, line 42, after "9" insert ---- and depicts the adjustment mechanism for adjusting the position of the guide nozzle ----.

Column 2, line 43, after "adjustment" insert ---- mechanism ----.

UNITED STATES PATENT AND TRADEMARK OFFICE

CERTIFICATE OF CORRECTION

PATENT NO. : 4,438,916

DATED : March 27, 1984

INVENTOR(S) : Shoichi Kawaguchi

It is certified that error appears in the above-identified patent and that said Letters Patent is hereby corrected as shown below:

Column 2, line 48, delete "comprises" and insert ---- includes ----.

Column 2, line 50, delete "1". Same line, after "paper" insert ---- 1 ----.

Column 2, line 59, after "one" insert ---- of which is ----.

Column 2, line 62, after "one" insert ---- of which is ----.

Column 3, line 16, delete "follower" and insert ---- lever ----.

Column 3, line 17, after "bring" insert ---- the ----.

Column 3, line 36, delete "feeding" and insert ---- transport ----.

Column 3, line 64, delete "16" and insert ---- 10 ----.

Column 4, line 35, delete "the", second occurrence.

Column 4, line 36, delete "drawing of" and insert ---- paper illustrated in ----.

UNITED STATES PATENT AND TRADEMARK OFFICE

CERTIFICATE OF CORRECTION

PATENT NO. : 4,438,916

DATED : March 27, 1984

INVENTOR(S) : Shoichi Kawaguchi

It is certified that error appears in the above-identified patent and that said Letters Patent is hereby corrected as shown below:

Column 4, line 38, delete "stacked". Same line, after "sheets" insert ---- of paper ----. Same line, after "22" delete ", and the" and insert ---- which are provided in a sheet stack 22a. The ----.

Column 4, line 39, delete "stacked sheets" and insert ---- sheet stack 22a ----.

Column 4, line 43, delete "25", second occurrence.

Column 4, line 45, delete "25", second occurrence.

Column 5, line 20, after "its" insert ---- central ----. Same line, delete "27," and insert ---- 27. ----.

Column 5, line 21, delete "the" and insert ---- The ----. Same line, delete "extending" and insert ---- extends ----.

Column 5, line 37, after "(Fig. 5)" delete ", the" and insert ---- . The ----.

Column 5, line 54, after "the" insert ---- U-shaped ----. Same line, delete "there is disposed a nut 47" and insert ---- a nut 47 is disposed which is ----.

UNITED STATES PATENT AND TRADEMARK OFFICE

CERTIFICATE OF CORRECTION

PATENT NO. : 4,438,916

DATED : March 27, 1984

INVENTOR(S) : Shoichi Kawaguchi

It is certified that error appears in the above-identified patent and that said Letters Patent is hereby corrected as shown below:

Column 6, line 4, after "with" insert ---- the ----. Same line, after "sucking" insert ---- action ----.

Column 6, line 17, after "of" insert ---- its ----.

Column 6, line 23, delete "9" and insert ---- 8 ----.

Column 6, line 25, delete "21, each end 62 being" and insert ---- 21. The axis F of each axial end 62 is ----.

Column 6, line 26, delete "with respect to the" and insert ---- relative to the axis F, ----.

Column 6, line 27, delete "center".

Column 6, line 32, after "72" delete ", the" and insert ---- . The ----.

Column 6, line 33, delete "being", first occurrence, and insert ---- is ----.

Column 6, line 36, after "worm" insert ---- gear ----.

Column 6, line 37, delete "mesh" and insert ---- meshing engagement ----.

UNITED STATES PATENT AND TRADEMARK OFFICE

CERTIFICATE OF CORRECTION

PATENT NO. : 4,438,916

DATED : March 27, 1984

INVENTOR(S) : Shoichi Kawaguchi

It is certified that error appears in the above-identified patent and that said Letters Patent is hereby corrected as shown below:

Column 6, line 39, delete "63" and insert ---- 53 ----. Same line, delete "an axis F1" and insert ---- the axis $F_1$ ----.

Column 6, line 40, delete "latter" and insert ---- lever shaft ----. Same line, delete "an" and insert ---- the ----.

Column 6, line 43, delete "F1" and insert ---- $F_1$ ----.

Column 6, line 53, delete "nozzle" and insert ---- nozzles ----.

Column 6, line 56, delete "An" and insert ---- The ----.

Column 6, line 57, delete "nozzle" and insert ---- nozzles ----.

Column 6, line 68, delete "stacked pile of sheets 22 of paper" and insert ---- sheet stack 22a ----.

Column 7, line 3, delete "sheets 22" and insert ---- the sheets of paper 22 ----.

Column 7, line 10, delete "inner" and insert ---- compression coil ----.

Column 7, line 12, delete "bottoms" and insert ---- bottom ----.

UNITED STATES PATENT AND TRADEMARK OFFICE

CERTIFICATE OF CORRECTION

PATENT NO. : 4,438,916

DATED : March 27, 1984

INVENTOR(S) : Shoicki Kawaguchi

It is certified that error appears in the above-identified patent and that said Letters Patent is hereby corrected as shown below:

Column 7, line 15, delete "inner" and insert ---- compression coil ----.

Column 7, line 17, delete "sheet" and insert ---- topmost sheet of paper ----.

Column 7, line 32, delete "piled sheets 22" and insert ---- sheet stack 22a ----.

Column 7, line 34, delete "floating" and insert ---- topmost ----. Same line, after "sheet" insert ---- of paper ----.

Column 7, line 35, delete "inactivated" and insert ---- deactivated ----.

Column 7, line 36, delete "approaches the" and insert ---- approach ----.

Column 7, line 38, delete "inner" and insert ---- compression coil ----.

Column 7, line 44, delete "the", second occurrence.

UNITED STATES PATENT AND TRADEMARK OFFICE

CERTIFICATE OF CORRECTION

PATENT NO. : 4,438,916

DATED : March 27, 1984

INVENTOR(S) : Shoichi Kawaguchi

It is certified that error appears in the above-identified patent and that said Letters Patent is hereby corrected as shown below:

Column 7, line 61, delete ""nozzle 34" and insert ---- suction nozzles 34 ----.

Column 8, line 11, delete "since" and insert ---- Since ----.

Column 8, line 22, after "threaded" insert ---- inner end ----.

Column 8, line 32, after "when" insert ---- it is ----.

Column 8, line 36, delete "to" and insert ---- effectively ----.

Column 8, line 37, delete "a nicety". Same line, delete "with ease".

Column 8, line 42, delete "F1" and insert ---- $F_1$ ----. Same line, delete "63" and insert ---- 53 ----.

Column 8, line 43, after "axis" insert ---- F ----. Same line delete "eccentric shaft" and insert ---- axial ----.

Column 9, line 18, delete "143" and insert ---- 142 ----.

UNITED STATES PATENT AND TRADEMARK OFFICE

CERTIFICATE OF CORRECTION

PATENT NO. : 4,438,916

DATED : March 27, 1984

INVENTOR(S) : Shoichi Kawaguchi

It is certified that error appears in the above-identified patent and that said Letters Patent is hereby corrected as shown below:

Column 9, line 29, delete ", 26".

Column 9, line 30, delete "39, 142" and insert ---- 42 or 142 ----.

Column 9, line 33, delete "shaft" and insert ---- rod ----.

Column 9, line 34, delete "shaft" and insert ---- adjustment rod ----.

Column 9, line 37, delete "shaft" and insert ---- rod ----.

In The Claims

Column 10, line 7, after "separation" insert ---- suction ----.

Column 10, line 13, delete "including" and insert ---- comprising ----.

Column 10, line 37, delete "has" and insert ---- further comprises ----. Same line, delete "small".

UNITED STATES PATENT AND TRADEMARK OFFICE

CERTIFICATE OF CORRECTION

PATENT NO. :4,438,916

DATED :March 27, 1984

INVENTOR(S) :Shoichi Kawaguchi

It is certified that error appears in the above-identified patent and that said Letters Patent is hereby corrected as shown below:

Column 10, line 40, delete "small".

In The Abstract

Line 1, delete "comprises" and insert -- including --.

Figures 2,4,6,8, 9 and 10 should be deleted to be replaced with Figures 2,4,6,8, 9 and 10 as shown on the attached sheets.

Signed and Sealed this

*Twenty-fourth* Day of *December 1985*

[SEAL]

*Attest:*

DONALD J. QUIGG

*Attesting Officer*

*Commissioner of Patents and Trademarks*